US007635195B2

(12) United States Patent
Tarter

(10) Patent No.: US 7,635,195 B2
(45) Date of Patent: Dec. 22, 2009

(54) HEADLAMP THAT IS CONVERTIBLE TO A LANTERN

(75) Inventor: Kevin J. Tarter, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 11/942,357

(22) Filed: Nov. 19, 2007

(65) Prior Publication Data

US 2008/0117623 A1 May 22, 2008

Related U.S. Application Data

(60) Provisional application No. 60/866,766, filed on Nov. 21, 2006.

(51) Int. Cl.
*F21L 19/00* (2006.01)

(52) U.S. Cl. ..... 362/162; 362/20; 362/186; 362/285

(58) Field of Classification Search ..... 362/105, 362/106, 162, 183, 186, 194, 203, 205, 276, 362/285, 363, 394, 450, 800, 802
See application file for complete search history.

(56) References Cited

U.S. PATENT DOCUMENTS

| | | | | |
|---|---|---|---|---|
| 1,904,902 | A * | 4/1933 | Pratt | 362/105 |
| 2,071,557 | A * | 2/1937 | Miyaoka | 362/105 |
| 2,530,069 | A | 11/1950 | Moore | |
| 4,186,430 | A | 1/1980 | Britton | |
| 4,286,310 | A | 8/1981 | Brainkel et al. | |
| 4,520,431 | A | 5/1985 | Fanelli et al. | |
| 4,566,055 | A | 1/1986 | Klees et al. | |
| 4,646,213 | A | 2/1987 | Fanelli et al. | |
| D293,482 | S | 12/1987 | Geissler | |
| 4,926,297 | A | 5/1990 | Masters et al. | |
| D317,057 | S | 5/1991 | Argandona | |
| 5,016,148 | A | 5/1991 | Kohm | |
| D321,568 | S | 11/1991 | Yuen | |
| 5,343,825 | A | 9/1994 | Gazecimeon et al. | |
| 5,383,104 | A | 1/1995 | Hou | |
| 5,424,928 | A | 6/1995 | Jordan et al. | |
| D363,563 | S | 10/1995 | Yuen | |
| 5,642,931 | A | 7/1997 | Gappelberg | |
| 5,758,949 | A | 6/1998 | Van Deursen | |
| 6,030,094 | A | 2/2000 | Sedovic et al. | |
| 7,021,788 | B2 * | 4/2006 | Poon | 362/186 |
| 7,066,621 | B2 * | 6/2006 | Booty | 362/184 |
| 2002/0149928 | A1 * | 10/2002 | Watterson et al. | 362/184 |
| 2005/0099803 | A1 * | 5/2005 | Krieger | 362/183 |
| 2007/0159816 | A1 * | 7/2007 | Bayat et al. | 362/184 |

FOREIGN PATENT DOCUMENTS

| | | |
|---|---|---|
| GB | 2242732 | 10/1991 |

* cited by examiner

*Primary Examiner*—Hargobind S Sawhney
(74) *Attorney, Agent, or Firm*—Kelly S. Elsea

(57) ABSTRACT

A headlamp (20) that is convertible to a lantern. In an embodiment, the headlamp (20) includes an extension housing (24) and a main housing (22). The extension housing (24) is translatable relative to the main housing (22). In a first position, when the extension housing (24) is fully pressed into the main housing (22), a primary light (44) for the headlamp (20) is illuminated, providing a headlight function. The opposite end of the main housing (22) may include, for example, a clip, clasp, or other suitable structure (34) for attaching the headlamp to a headband.

13 Claims, 1 Drawing Sheet

HEADLAMP THAT IS CONVERTIBLE TO A LANTERN

REFERENCE TO RELATED APPLICATIONS

This application claims priority to U.S. provisional patent application Ser. No. 60/866,766, filed Nov. 21, 2006, and incorporated herein by reference.

BACKGROUND OF THE INVENTION

Active people often find themselves in need of a portable light source, such as while backpacking, hiking, performing auto maintenance, or spelunking, for example. Flashlights are most often used to provide the light source, especially where a power outlet is not readily available. Other options include handheld "drop" lights powered by extension cords, and cord or battery-powered lights that are fixed to portable floor stands.

Although flashlights work well for their intended purpose, they are often inconvenient in that a user must hold the light to direct it to suitable location, which may be difficult if the user needs both hands for performing work or other tasks. Alternatively, a user must find a suitable support where the light will directly illuminate the work area. This solution is satisfactory only if the user desires for the focus of the light to remain fixed, and can be inconvenient if the user has to often adjust the direction of the light, or if the user needs illumination while moving.

The use of hand-held drop lights with extension cords has numerous possible disadvantages depending on the work situation. Some of the possible disadvantages include the inconvenience of manipulating the long and somewhat inflexible heavy cord, cords which are not always long enough to reach outlets, work areas where electric outlets are not available at all, and the lack of a suitable place to attach or lay the light so it will illuminate directly onto the work surface. Most of the possible disadvantages associated with drop lights may also be applicable to lights attached to portable floor stands.

In an attempt to solve some of the above stated problems, powered lamps have in the past been provided which are mountable to a person's head. Such lamps are sometimes called "headlamps." The headlamps may be attached to helmets, for example, or may be attached to straps that are worn around a user's head. The headlamps are convenient in that the light may be positioned to illuminate an area that the user wishes to see, usually straight out from the user's head. Headlamps are also convenient in that they leave both of the user's hands free for performing tasks.

Headlamps have particularly become popular for backpacking. The headlamps typically are lightweight, and provide hands-free use, permitting a backpacker to search for and carry firewood, build a fire, erect a tent or establish a campsite, or perform other tasks without having to hold a light in the backpacker's hands.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description of some embodiments that are presented later.

In accordance with an embodiment, a headlamp is provided that is convertible to a lantern. In an embodiment, the headlamp includes an extension housing and a main housing. The extension housing is translatable relative to the main housing. In a first position, when the extension housing is fully pressed into the main housing, a primary light for the headlamp is illuminated, providing a headlight function. The opposite end of the main housing may include, for example, a clip, clasp, or other suitable structure for attaching the headlamp to a headband.

In a second, extended position, the extension housing is translated outward relative to the main housing. An internal switch within the headlamp is actuated, turning off the headlamp lamp. The same switch or a separate switch turns on lamps that illuminate around a portion of the extension housing. In this manner, a lantern function is provided by the headlamp. If desired, the headlamp may include a base so that it may stand upright when used as a lantern.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
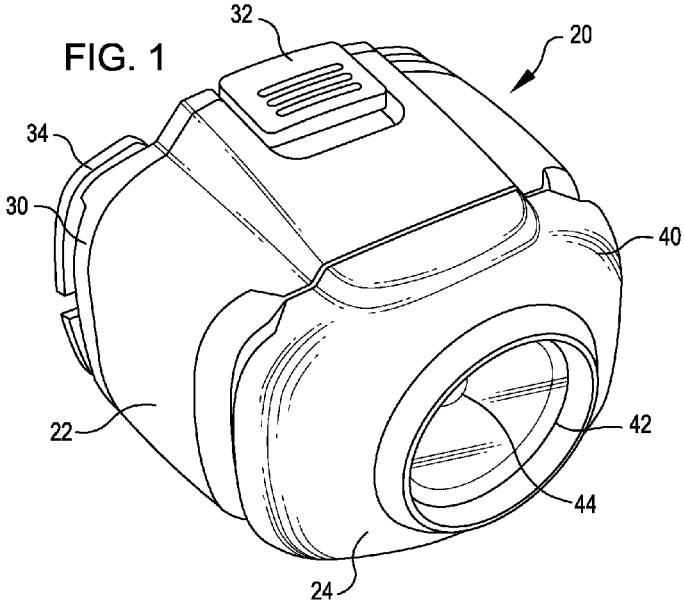
FIG. 1 is a top, front, side perspective view of a headlamp in accordance with an embodiment, shown in a retracted position.

Referring now to the drawings, in which like reference numerals represent like parts throughout the several views, FIG. 1 shows a headlamp 20 in accordance with an embodiment. The headlamp 20 includes a main housing 22 and an extension housing 24. Briefly described, the extension housing 24 is translatable between a first position shown in FIG. 1 in which the extension housing 24 is substantially against the main housing 22, and a second position shown in FIG. 2 in which the extension housing 24 is translated outward relative to the main housing.

The main housing 22 includes an inner storage area for receiving batteries. A removable battery plate 30 is positioned on a rear portion of the main housing. The main housing 22 includes a cam latch 32 for permitting removal of the battery plate and access to the battery compartment.

On a rear portion of the battery plate 30 is a strap attachment 34. This strap attachment 34 is designed for receiving a portion of a headband (not shown, but known). In alternate embodiments, the strap attachment 34 may be a clasp, latch, hook, clip, or any suitable structure for permitting the headlamp 20 to be attached to the head of a user, either to a band or another structure. In addition, if desired, the strap attachment or other structure may be attached to a place on the main housing other than the battery plate 30.

The battery plate 30 positioned on the rear of the main housing 22 in the embodiment shown in the drawings, but it is to be understood that batteries may be removed in another manner or direction out of the main housing, may be stored in a separate compartment and connected to a headlamp by a wire, or the headlamp may include rechargeable batteries, wherein the inside of the main housing may not need to be accessed.

Figure 2:
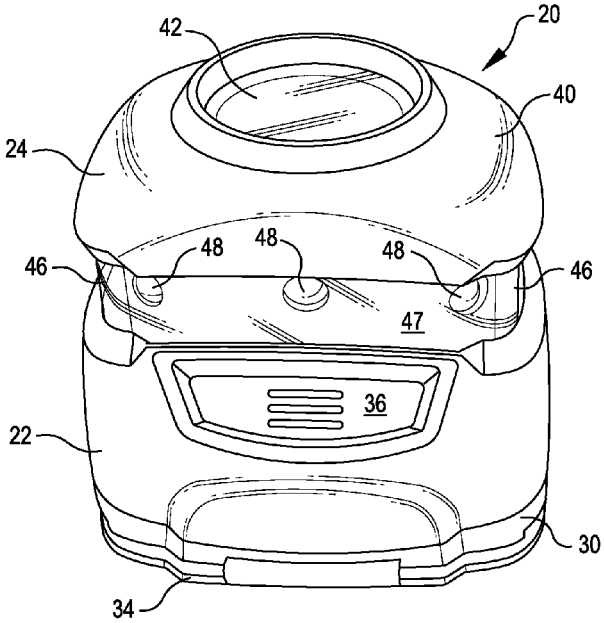
FIG. 2 is a bottom, front, side perspective view of the headlamp of FIG. 1, shown in an extended position.

As can be seen in FIG. 2, a control 36, such as a push button, is provided for turning on the headlamp 20. In the embodiment shown in the figures, the control 36 is positioned on the bottom of the main housing 22, but the control may be positioned in another suitable location. In addition, other types of controls may be provided which may be on or separated from the main housing 22 and/or the headlamp 20.

In accordance with an embodiment, the main housing 22 is hollow in configuration, and batteries 50 (FIG. 3) for the headlamp are situated near a center portion of the main housing. The outer inside portions of the main housing 22 are devoid of batteries or other structures so that these outer areas may receive portions of the extension housing 24 when the extension housing is in the closed position shown in FIG. 1. The main housing 22 may be otherwise situated. For example, the batteries may extend around the perimeter of the housing, or may be located at a bottom of the housing.

The extension housing 24 includes a nose piece 40 having a reflector 42 on an outer, front portion with a lamp 44 (shown in part in FIG. 1) mounted therein. The lamp 44 may be, for example, one or more light emitting diode (LED) lamps, incandescent lamps, or other suitable lights. As an alternative to the reflector 42 and the lamp 44, one or more LEDs may be utilized that are designed to direct light as a beam. Other alternatives may be used, but in general, a primary light source is provided that is used for illumination during a headlamp function.

An outer globe 46 (FIG. 2) extends rearward from the outer periphery of the rear of the nose piece 40. The outer globe 46 is shown in FIG. 2 in a translated position. The outer globe 46 is slidingly received in the main housing 22 and moves into the main housing 22 when in the closed position shown in FIG. 1. An extension body 47 is positioned behind the outer globe 46 and includes a series of recessed lamps 48 mounted therein. The recessed lamps 48 may also be one or more LED lamps, incandescent lamps, or other suitable lights. In the embodiment shown in the drawings, the number of recessed lamps 46 is six (one each on each corner, and one each centered on the top and the bottom; only three are shown in FIG. 2), but any suitable number may be used. The extension body 47 and the recessed lamps 48 translate with the outer globe 46 into the main housing when the headlamp 20 is moved between the opened and closed positions shown in FIG. 2 and FIG. 1, respectively.

Figure 3:
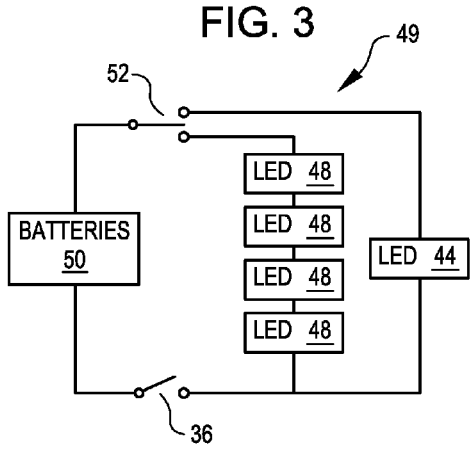
FIG. 3 is a representation of a circuit that may be used with the headlamp of FIG. 1 in accordance with an embodiment.

FIG. 3 shows a circuit 49 that may be used with the headlamp 20 in accordance with an embodiment. The circuit includes a battery 50 or batteries, which may be dry cell disposable batteries or rechargeable batteries. The control 36 selectively provides current from the batteries 50 to the circuit 49. A sliding double pole switch 52 is provided that is mounted so that it is structurally interconnected between the main housing 22 and the extension housing 24. The sliding switch 52 is configured and arranged such that movement of the extension housing 24 relative to the main housing 22 causes the sliding switch 52 to switch between the two separate poles. An example of a sliding switch that may be utilized is shown in U.S. Pat. No. 6,030,094, entitled "Collapsible Lantern with Automatic Shut-Off Feature," and assigned to the assignee of the present invention. Other sliding switches may be used.

The sliding switch 52 is configured so that when the control 36 is in an "on" position and the sliding switch is in a first position corresponding to the extension housing 24 being in the closed position shown in FIG. 1, the lamp 44 is provided current, and the headlamp 20 provides a headlamp function. When the extension housing 24 is moved to the extended position shown in FIG. 2, the sliding switch 52 moves to the second pole position, providing current to the recessed lamps 48. In this configuration, the headlamp 20 provides a lantern function.

Other switches may be used, and the function of the switches may or may not be tied to movement of the extension housing 24. As an example, separate switches may be provided for the lamp 44 and the lamps 48. In such an embodiment, the lamp 44 and the lamps 48 may be illuminated at the same time.

The headlamp 20 is convenient in that it may be used both as a headlamp and as a lantern. In this manner, a backpacker may bring only the headlamp 20 in a backpacking environment, instead of both a headlamp and a lantern. The backpacker may utilize the headlamp 20 in the headlamp configuration with the headlamp clamped to a headband or otherwise attached to the head or other body parts of a user. In this configuration, the backpacker may perform active chores, such as erecting a tent or establishing a campsite.

The backpacker may later remove the headlamp from the head strap, and may stand the headlamp on the strap attachment 34. To this end, the strap attachment 34 or any other structure that is used for the rear of the headlamp preferably includes a surface or structure to aid in standing the headlamp in the lantern configuration. In the embodiment shown in the drawings, the strap attachment 34 is generally flat to aid in this function. Before or after the headlamp is standing upright, the backpacker pulls the extension section 24 outward relative to the main housing 22 so that the headlamp 20 may be used as a lantern.

By providing the dual function of a headlamp and a lantern, the headlamp 20 permits a backpacker to carry a single light, thus eliminating some weight and/or bulk on a backpacking trip. The headlamp 20 converts between these two different functions without the addition or removal of parts.

The headlamp 20 may be configured in different ways. For example, instead of an extension section, a sliding panel may be arranged that moves back and forward to cover lantern lights. The panel may trip a switch, such as the switch 48, or a different control may be used. In addition, in another embodiment, lights for both a lantern function and a headlamp function may be exposed at all times, and a control may be provided for switching between the two functions. However, such embodiments do not benefit from the feature of the present invention that permits the headlamp 20 to be small and compact when used as a headlamp, and to extend to a larger size for use as a lantern.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A headlamp assembly, comprising:

a main housing;

a structure for mounting the main housing to a head of a user;

an extension housing, the extension housing being translatable outward relative to the main housing between a first, closed position and a second, extended position;

a headlamp emitting element on the extension housing that provides a headlamp function; and at least one lantern light emitting element that is exposed when the extension housing is in the second, extended position and that is covered when the extension housing is in the first, closed position.

2. The headlamp of claim 1, wherein the structure comprises a strap attachment.

3. The headlamp of claim 1, further comprising batteries for powering the headlamp light emitting element and said at least one lantern light emitting element.

4. The headlamp of claim 3, wherein the perimeter of the interior of the main housing is devoid of batteries or other obstructions so that portions of the exterior housing may slide into the main housing when the extension housing is in the second, closed position.

5. The headlamp of claim 1, wherein the extension housing comprises a nose piece with the headlamp light emitting element mounted thereon.

6. The headlamp of claim 5, further comprising a reflector mounted on the nose piece, and wherein the headlamp light emitting element is mounted in the reflector.

7. The headlamp of claim 5, further comprising an outer globe, and wherein said at least one lantern light emitting element is mounted inside the globe so that when said at least one lantern light emitting element is illuminated, light from the lantern light emitting element transmits out of the outer globe.

8. The headlamp of claim 7, wherein the outer globe extends rearward from an outer periphery of a rear of the nose piece, and the globe is fixed for movement with the nose piece.

9. The headlamp of claim 7, wherein the outer globe is covered more when the extension housing is in the first, closed position than when the extension housing is in the second, extended position.

10. The headlamp of claim 9, further comprising an extension body positioned in side the outer globe, and wherein said at least one lantern light emitting element is mounted on the extension body.

11. The headlamp of claim 10, wherein the extension body and the outer globe are fixed for movement with the nosepiece.

12. The headlamp of claim 1, further comprising a switch that connects the batteries to the headlamp light emitting element when the extension housing is in the first closed position, and which connects the batteries to said at least one lantern light emitting element when the extension housing is in the second, extended position.

13. The headlamp of claim 12, wherein the switch comprises a sliding switch.

* * * * *